US008475856B2

(12) United States Patent
Sheehan

(10) Patent No.: US 8,475,856 B2
(45) Date of Patent: Jul. 2, 2013

(54) OTG (ON THE GO) SPECIALTY MULTI-BEVERAGE CONTAINER SYSTEMS

(75) Inventor: Andrew Sheehan, Mound, MN (US)

(73) Assignee: Andrew Sheehan

( * ) Notice: Subject to any disclaimer, the term of this patent is extended or adjusted under 35 U.S.C. 154(b) by 107 days.

(21) Appl. No.: 13/239,218

(22) Filed: Sep. 21, 2011

(65) Prior Publication Data

US 2012/0074003 A1 Mar. 29, 2012

Related U.S. Application Data

(60) Provisional application No. 61/385,665, filed on Sep. 23, 2010.

(51) Int. Cl.
*B65D 81/32* (2006.01)

(52) U.S. Cl.
USPC ..... 426/115; 426/112; 426/106; 426/119; 206/221; 206/219; 220/521; 220/524; 220/529; 220/500; 222/144.5; 222/145.5

(58) Field of Classification Search
USPC ..... 426/106–107, 112, 115, 117, 119–120, 426/392, 394, 589–599; 206/219–222; 220/500, 220/521, 524, 529; 222/129, 142.1, 142.4, 222/144.5, 145.5
See application file for complete search history.

(56) References Cited

U.S. PATENT DOCUMENTS

| | | | | |
|---|---|---|---|---|
| 2,665,816 | A | 1/1954 | Anft et al. | |
| 2,675,815 | A * | 4/1954 | Dale | 137/43 |
| 3,321,097 | A | 5/1967 | Solowey | |
| 3,743,520 | A | 7/1973 | Croner | |
| 4,194,619 | A | 3/1980 | Schley | |
| 4,691,821 | A | 9/1987 | Hofmann | |
| 4,785,931 | A * | 11/1988 | Weir et al. | 206/222 |
| 4,856,995 | A * | 8/1989 | Wagner | 433/215 |
| 5,984,141 | A * | 11/1999 | Gibler | 222/80 |
| 6,444,174 | B1 * | 9/2002 | Lascombes | 422/554 |
| 6,705,491 | B1 | 3/2004 | Lizerbram et al. | |
| 6,820,767 | B2 * | 11/2004 | Nicholas | 222/144.5 |
| 6,959,841 | B2 * | 11/2005 | Vlodek | 222/129 |
| 7,562,770 | B1 | 7/2009 | Roque | |
| 8,376,134 | B1 * | 2/2013 | Underwood | 206/221 |
| 2006/0226035 | A1 * | 10/2006 | Smith et al. | 206/219 |
| 2006/0254936 | A1 | 11/2006 | Corbitt et al. | |
| 2008/0072433 | A1 | 3/2008 | Ohring et al. | |

* cited by examiner

*Primary Examiner* — Drew Becker
*Assistant Examiner* — Luana Z Long
(74) *Attorney, Agent, or Firm* — Edwin Wold; Rachel Gilboy

(57) ABSTRACT

A multi-beverage container and mixing system to increase the convenience of mixing and transporting a variety of powder-based beverages in a single unit. The multi-beverage container employs a lid equipped with compartments designed to house multiple powder drink mixes and a container housing designed to accommodate water for mixing. At user activation, powder drink mix is released from a compartment and is mixed with the water to create the desired beverage for instant consumption by the user.

17 Claims, 5 Drawing Sheets

OTG (ON THE GO) SPECIALTY MULTI-BEVERAGE CONTAINER SYSTEMS

CROSS-REFERENCE TO RELATED APPLICATION

The present application is related to and claims priority from prior provisional application Ser. No. 61/385,665, filed Sep. 23, 2010 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

FIELD OF THE INVENTION

The present invention relates generally to the field of portable beverage containers and more specifically relates to hand-held containers for mixing and transporting multiple powder-based beverages in one unit.

DESCRIPTION OF THE RELATED ART

Many individuals in modern society find themselves away from home for the majority of any given day. Planning ahead to carry along sufficient beverages to keep one hydrated and refreshed is not only time-consuming, but the weight inherent in hauling several beverages may be cumbersome. Stopping periodically throughout the day at vending machines, convenience stores, and the like once again takes up valuable time and consumes what many consider to be non-disposable monetary resources. Without the availability of cupboards and refrigerators to rely upon when away from home, obtaining a beverage to slake one's thirst can be time consuming, expensive, and inconvenient. Many people like to mix powdered drinks for consumption during the course of the day. Often times this is highly inconvenient.

Various attempts have been made to solve the above-mentioned problems such as those found in U.S. Pat. and Pub. Nos. 2,665,816; 2008/0072433; 6,705,491; 3,321,097; 4,691,821; 3,743,520; 4,194,619; 7,562,770; and 2006/0254936. This prior art is representative of portable beverage containers. None of the above inventions and patents, taken either singly or in combination, is seen to describe the invention as claimed.

Ideally, a hand-held container for mixing and transporting multiple powder-based beverages should be compact, versatile, user friendly and, yet would operate reliably and be manufactured at a modest expense. Thus, a need exists for a reliable portable multi-beverage container system to increase the convenience of mixing and transporting a variety of powder-based beverages and to avoid the above-mentioned problems.

BRIEF SUMMARY OF THE INVENTION

In view of the foregoing disadvantages inherent in the known portable beverage container art, the present invention provides a novel OTG (On The Go) Specialty Multi-Beverage Container system. The general purpose of the present invention, which will be described subsequently in greater detail, is to provide a convenient hand-held means of mixing and transporting a variety of powder-based beverages in one device and/or assembly.

A portable multi-beverage container and mixing system is disclosed herein preferably comprising: a container housing, preferably comprising plastic, having at least one or a plurality of isolated inner volumes. The container comprises a lid having a plurality of compartments and at least one drink access spout. In preferred embodiments, the lid is coupleable to the container housing and comprises a sealable containment assembly which preferably comprises a thermal insulator. This thermal insulator effectively ensures the beverage surrounded by the container is kept at a lower temperature or an elevated temperature over an extended duration.

In preferred embodiments, the lid houses a plurality of compartments for the containment of at least one powdered beverage mix. Each compartment preferably comprises an external door for admitting a powdered beverage mix and an internal door for releasing a powdered beverage mix. The internal door (or lid) may comprise a compressible button, latch, lever, or the like that when triggered releases the internal door from a closed position to an open position (and back to a closed position when done), thereby allowing any powdered beverage mix contained in the compartment to fall into the water contained in the container housing. A set of opposing polarity magnets is preferably used to attach an internal door to the container housing in a closed position. These magnets may also be used to draw an internal door into a closed position from an open position after the button, latch, lever, etc. has been released. Springs or other suitable (equivalent) means may be used to return the internal door to its normally closed position.

For transportation purposes, the container housing may be coupled with the lid to define a cylinder capable of transporting beverages by hand-held means. For mixing purposes, the container housing may comprise markings used as volume measurement indicators along the outside surface of the housing. In this way, the powdered beverage mix may yield a sport drink or a non-sport drink when mixed with water.

A user of a multi-beverage container system may carry and mix various powdered beverage mixes with water using this system throughout the day. The multiple compartments preferably found in the lid of the device allow users to separately carry: multiple servings of a single beverage, individual servings of unlike beverages, or a combination of servings of like and unlike beverages in one container. At desired intervals throughout the day, a user of a multi-beverage container system may access and consume these desired beverages using the drink access spout on the lid.

A method of using a multi-beverage container and mixing system is also described herein preferably comprising the steps of: pouring water into at least one inner volume of a container housing through an external and/or internal door (or through a spout or by removing the lid to access) into a/the desired inner volume; closing at least one internal door; placing at least one powdered beverage mix inside at least one compartment of a lid through an external door; closing the external door; and transporting the powdered beverage mix(es) and water in an unmixed state. The method preferably further comprises the steps of: activating the internal door via a push-button; and mixing the powdered beverage mix from at least one compartment of the lid with water in the inner volume of the container housing at a user-preferred interval, yet not mixing other powdered beverage mix(es) stored in other compartments of the lid, allowing the mix(es) to be mixed independently with water in the designated inner volume at later interval(s) (or by rinsing and re-filling the water if in a single inner volume.)

The present invention holds significant improvements and serves as a portable beverage container system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, OTG (On The Go) Specialty Multi-Beverage Container Systems, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a portable beverage containment device and more particularly to an OTG (On The Go) specialty multi-beverage container system as used to improve the convenience of mixing and transporting a variety of powder-based beverages for consumption during a time period.

Figure 1A:
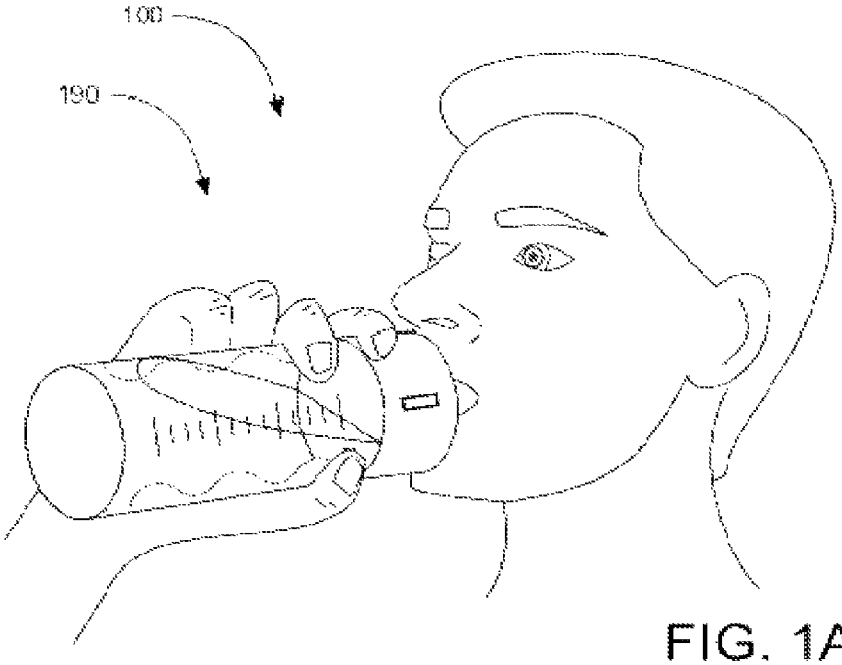
FIG. 1A shows a perspective view illustrating a multi-beverage container and mixing system in an in-use condition according to an embodiment of the present invention.
Figure 1B:
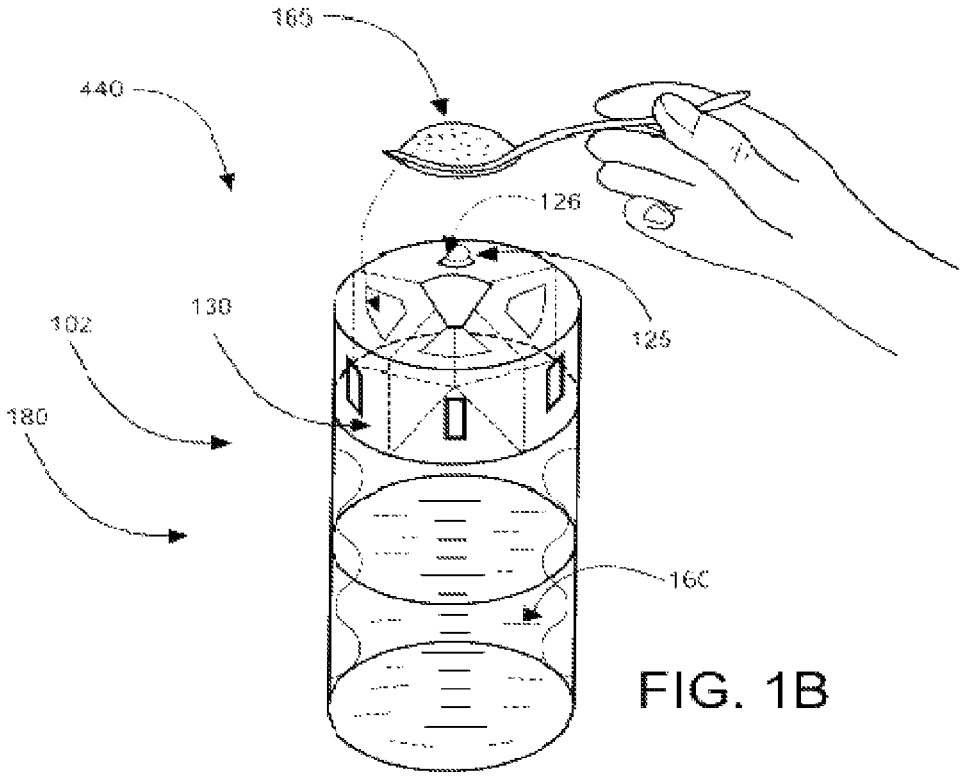
FIG. 1B shows a perspective view illustrating a multi-beverage container receiving a powdered beverage to be intermixed with water contained therein at a later interval according to an embodiment of the present invention.

Referring to the drawings by numerals of reference there is shown in FIGS. 1A and 1B, perspective views illustrating multi-beverage container and mixing system 100 in an in-use condition 190 and container housing 110, respectively according to an embodiment of the present invention.

Multi-beverage container and mixing system 100 preferably comprises: container housing 110 having at least one isolated inner volume 111 (or a plurality in alternate embodiments); and lid 120. Lid 120 preferably houses a plurality of compartment(s) 130 (in the present embodiment three compartment(s) 130 are shown however in alternate embodiments more or less compartment(s) 130 may be used) and at least one drink access spout 125. In the present version, lid 120 is coupleable to container housing 110, thereby defining a cylinder that is hand-holdable. Lid 120 is preferably coupleable to container housing 110 with such means as screw threads, snaps, suction means, etc. Those with ordinary skill in the art will now appreciate that upon reading this specification and by their understanding the art of coupling and/or fastening as described herein, methods of coupling and/or fastening two objects together to create one functioning unit will be understood by those knowledgeable in such art.

Within this particular embodiment shown, each compartment 130 may have at least one internal door 140 and at least one external door 150. External door(s) 150 may allow at least one user to fill at least one compartment(s) 130 with at least one beverage mix 165, while internal door(s) 140 may allow the beverage mix 165 contained in compartment 130 to be released into water 160 confined in container housing 110. When internal door(s) 140 are activated, fluid communication is permitted between compartment(s) 130 of lid 120 and inner volume 111 of container housing 110, whereby beverage mix(es) 165 and water 160 may be combined. Within this particular embodiment, inner volume 111 may be defined by the walls of container housing 110 and internal door(s) 140.

Internal door 140 preferably comprises at least one set of positive and negative magnet 145 insets (or suitable equivalent securing/opening and closing means) which may be used to temporarily lock internal door 140 in a closed position against container housing 110. A user depressible button 147 may trigger the positive and negative magnet(s) 145 to repel one from the other, thereby releasing internal door 140 from its attachment to container housing 110 and positioning internal door 140 in an open position. A user releasing button 147 may realign magnet(s) 145 to an attractive state, thereby drawing internal door 140 to a closed position once again against container housing 110. Those with ordinary skill in the art will now appreciate that upon reading this specification and by their understanding the art of magnetism as described herein, methods of manipulating polarity of magnets to facilitate the movement of attached members will be understood by those knowledgeable in such art.

Multi-beverage container and mixing system 100 of the present invention allows a user to separately carry and mix beverage mix(es) 165 with water 160 in order to create different beverages at desired intervals throughout the day. A user may access and consume a beverage mixed in such a way through drink access spout 125. Drink access spout 125 may have access to one or more inner volume(s) 111 and may be movable in certain embodiments between inner volume(s) 111. Drink access spout 125 in the present embodiment may comprise plug 126 used to prevent the contents of inner volume 111 from leaking or spilling from multi-beverage container and mixing system 100. Plug 126 may be sized to fit within drink access spout 125 to act as a stopper or may be sized to enclose drink access spout 125 to act as a cap. Drink access spout 125 may be rotatably opened.

Figure 2:
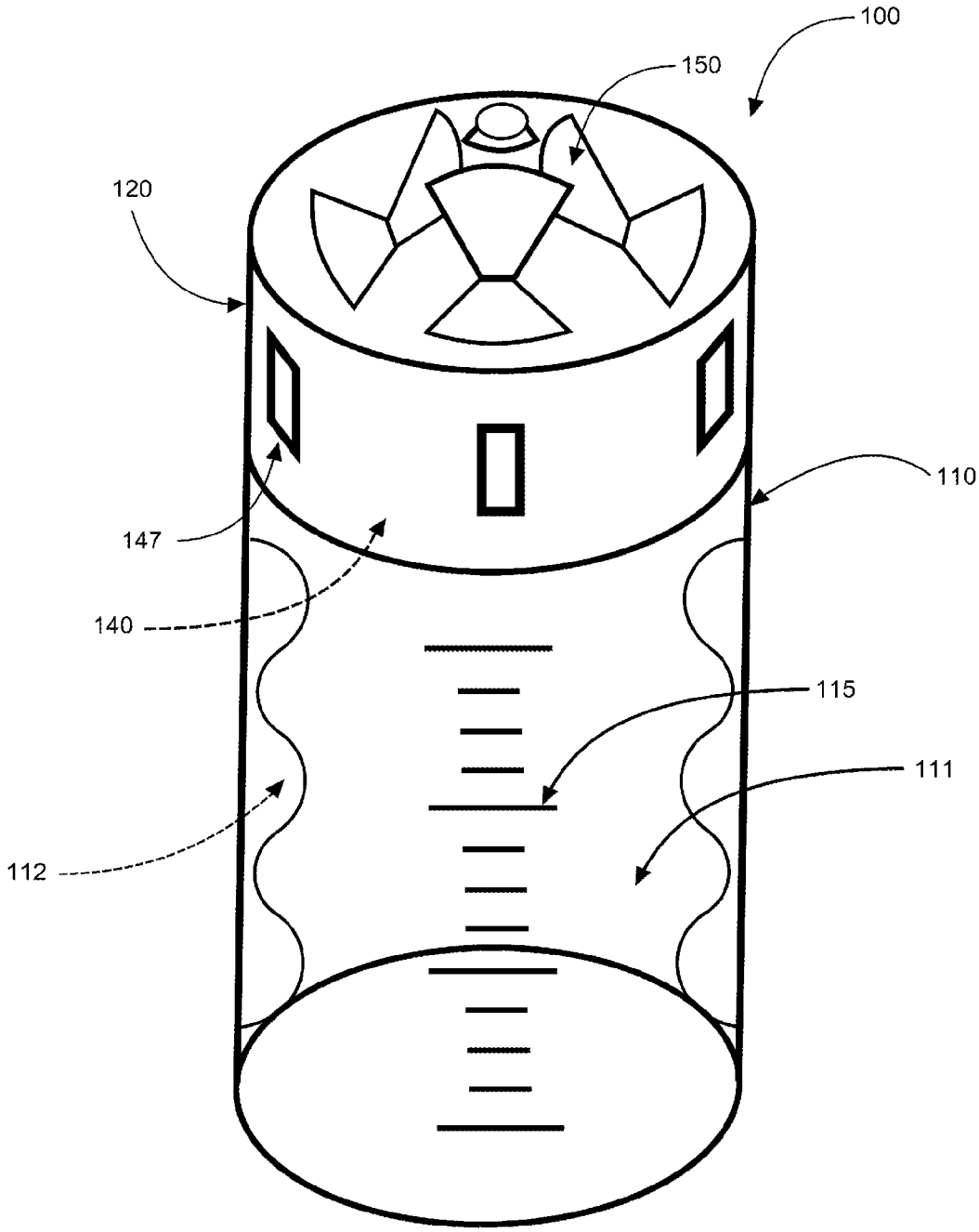
FIG. 2 is a perspective view illustrating the multi-beverage container and mixing system with external doors, buttons, and volume measurement indicia markings shown according to an embodiment of the present invention of FIG. 1A.

Referring now to FIG. 2, a perspective view illustrating multi-beverage container and mixing system 100 with external doors 150, buttons 147, and volume measurement indicia markings 115 shown according to an embodiment of the present invention of FIGS. 1A and 1B.

Multi-beverage container and mixing system 100 preferably comprises at least one volume measurement indicia marking 115 denoted, in the present embodiment, preferably along the vertical axis upon the outside wall of container housing 110, affixed preferably with a permanent means such as etching, embossing, screen-printing, or via other equivalent means. In preferred embodiments, the interior wall of container housing 110 preferably comprises extruding mix-ridge(s) 112 for the thorough mixing of beverage mix(es) 165 with water 160 when multi-beverage container system 100 is shaken.

Located at intervals around lid 120, in the preferred embodiment, is at least one compressible button 147 correlated to each internal door 140, whereby button 147 may activate the release of the correlating internal door 140 with which it is associated, causing beverage mix(es) 165 to fall into water 160 contained within inner volume 111. Button 147 may comprise a toggle switch, twistable knob, or the like.

Figure 3:
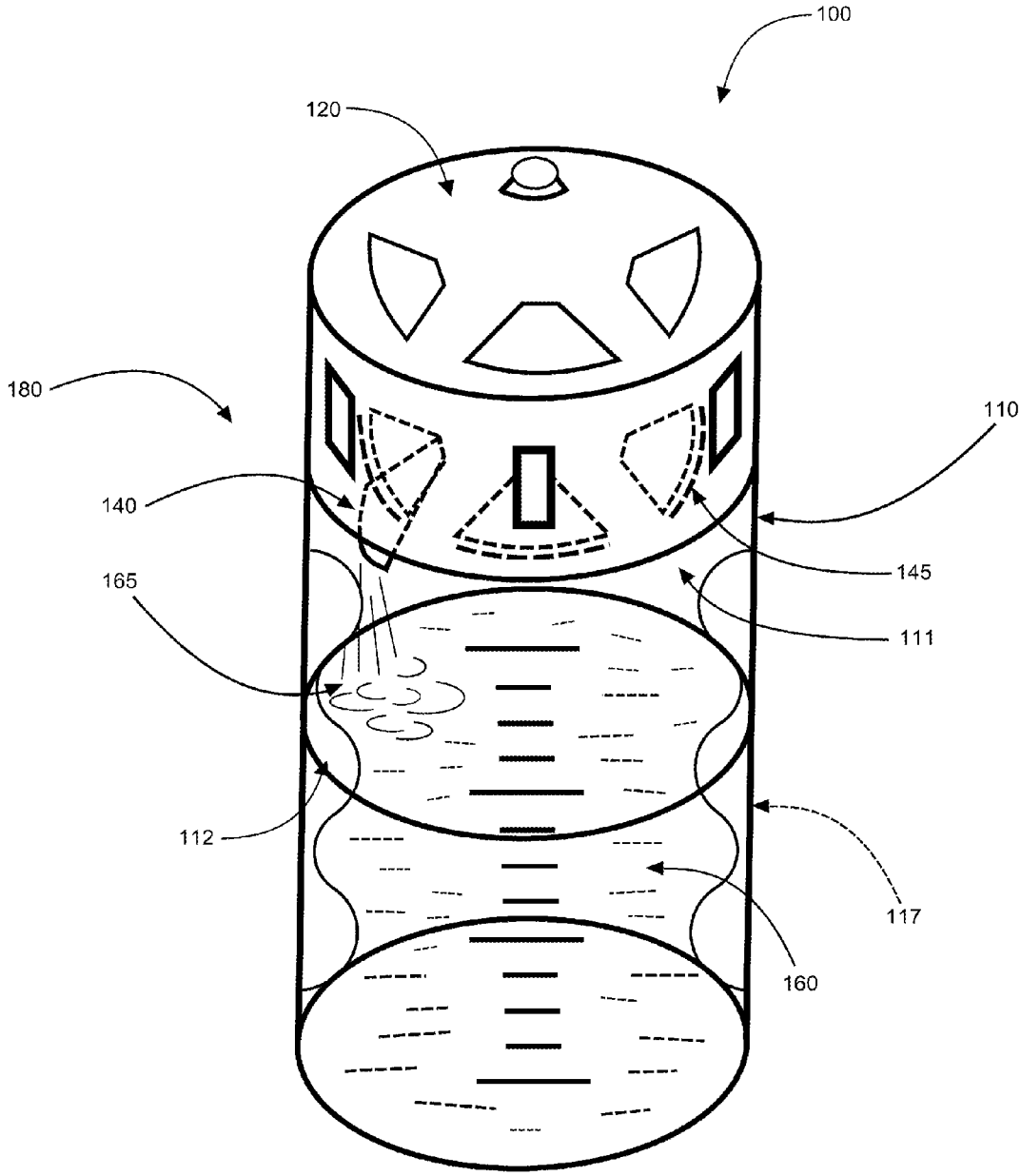
FIG. 3 is a perspective view illustrating the multi-beverage container and mixing system with internal doors, magnets, thermal insulation means, and mix-ridges shown according to an embodiment of the present invention of FIGS. 1A and 2.

FIG. 3 shows a perspective view illustrating multi-beverage container and mixing system 100 with internal doors 140, magnets 145, thermal insulation means (hereby embodying thermal insulator 117), and mix-ridges 112 shown according to an embodiment of the present invention of FIGS. 1A and 2.

The present figure illustrates multi-beverage container and mixing system 100 as a vessel in which beverage mix(es) 165 (comprising powder used in combination with water 160) may be used to create a sport drink or a non-sport drink, depending on the type of powder. Upon reading this specification, it should be appreciated that, under appropriate circumstances, considering such issues as user preferences, design preference, structural requirements, marketing preferences, cost, available materials, technological advances, etc., other (cold or hot—when mixed) powdered drinks such as, for example, health drinks, children's drinks such as Kool-Aid®, lemonade, iced-tea, coffee, tea, drinks for babies, etc., may be sufficient.

Container housing 110 and lid 120 preferably comprise a sealable containment assembly 180 to accommodate the sport or non-sport beverage. Thus connected, sealable containment assembly 180 may comprise thermal insulator 117; wherein thermal insulator 117 effectively ensures water 160 and/or mixed drink accommodated in inner volume 111 may be kept at a lower or elevated temperature, based on user-preference, over an extended duration.

Figure 4:
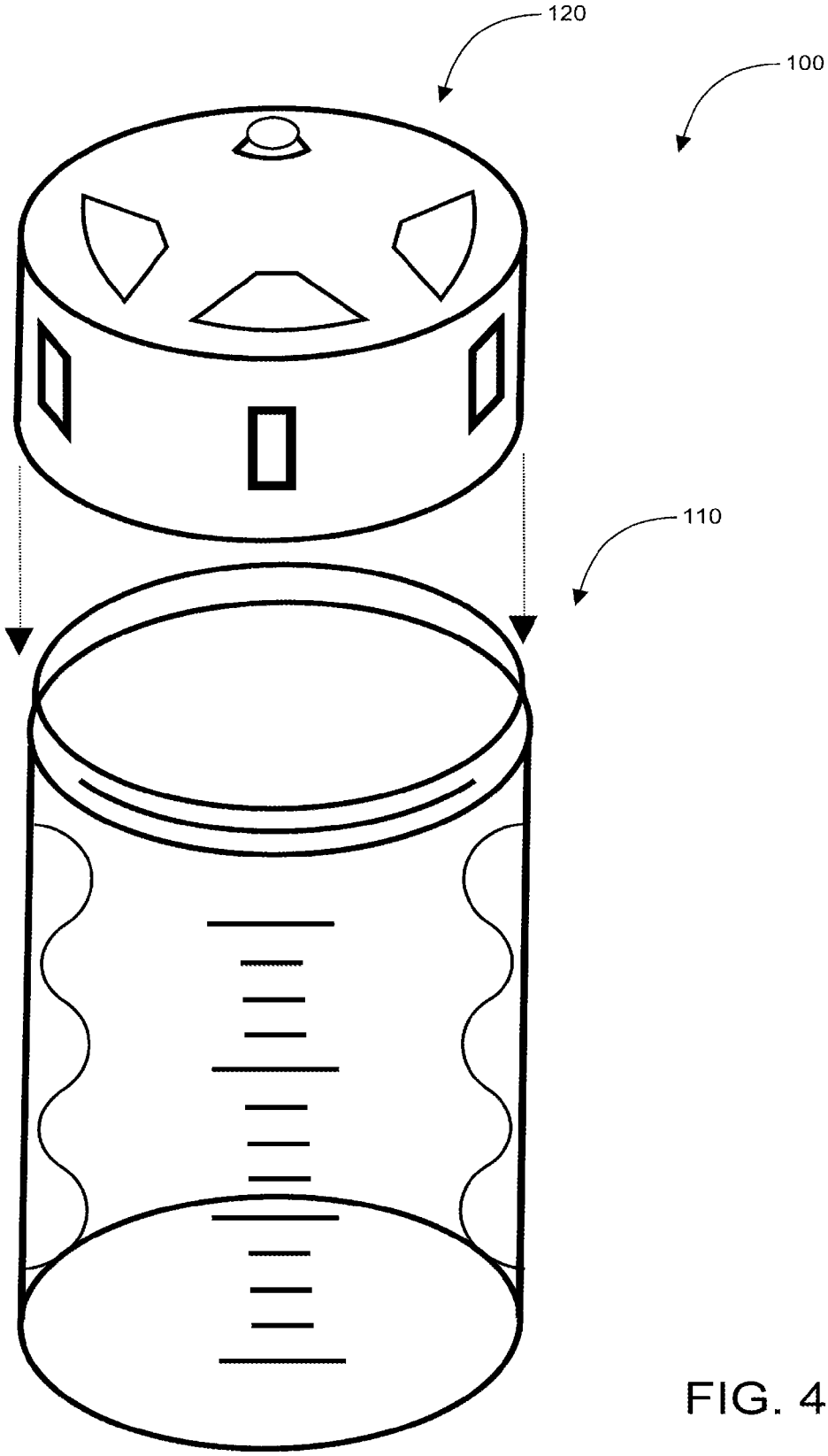
FIG. 4 is an exploded view illustrating a sealable containment assembly including a portable beverage container and a lid of the multi-beverage container and mixing system according to an embodiment of the present invention of FIGS. 1A-3.

Referring now to FIG. 4, an exploded view illustrating a sealable containment assembly 180 including portable beverage container 102 (container housing 110) and lid 120 of multi-beverage container and mixing system 100 according to an embodiment of the present invention of FIGS. 1A-3.

In preferred embodiments, sealable containment assembly 180 may be dismantled into individual components: container housing 110 and lid 120. Sealable containment assembly 180 may thus be stored as a single portable beverage container 102 or as separate components: container housing 110 and lid 120. When separated, container housing 110 and lid 120 may be cleaned between uses. Preferably designed to withstand dropping and other impacts, container housing 110 and lid 120 may be constructed of resilient light-weight material, such as plastic or the like. This material is able to withstand the heat of conventional dishwashing machines, thus making the container housing 110, lid 120, and their various components "dishwasher safe", and cost-efficient to maintain. Additionally, a preferred material for constructing container housing 110 may be translucent. The material used in constructing lid 120 may be translucent or opaque, based on the manufacturer's or user's preference. Those with ordinary skill in the art will now appreciate that upon reading this specification and by their understanding the art of materials as described herein, methods of production and materials for use in container making will be understood by those knowledgeable in such art.

Multi-beverage container and mixing system 100 may be sold as kit 440 comprising the following parts: at least one container housing 110; at least one lid 120; and at least one set of user instructions. Kit 440 may be sold in combination with or as a promotional item with beverage mix(es) 165. Multi-beverage container and mixing system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
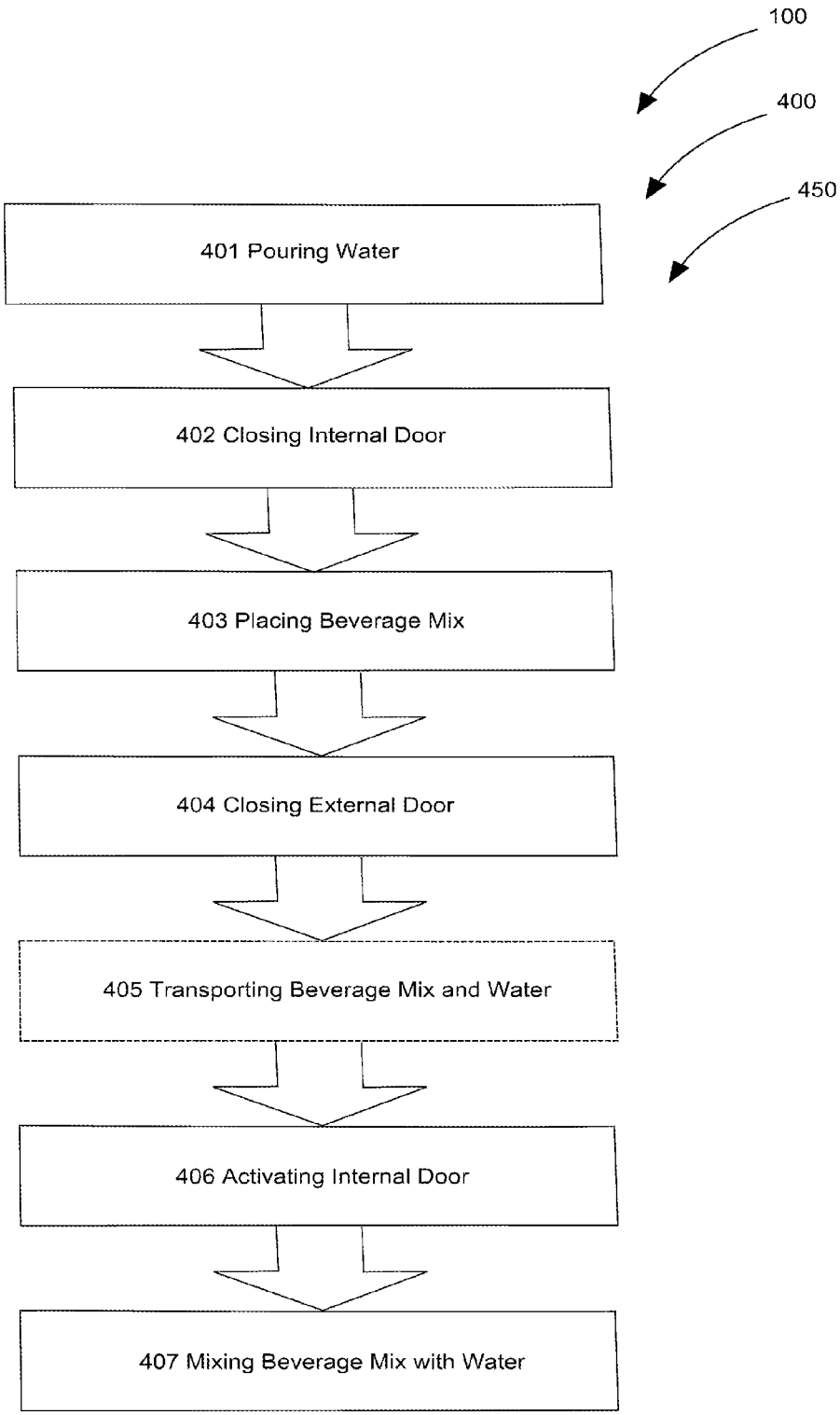
FIG. 5 is a flowchart illustrating a method of use for the multi-beverage container and mixing system according to an embodiment of the present invention of FIGS. 1A-4.

FIG. 5 is a flowchart 450 illustrating a method of use 400 for the multi-beverage container and mixing system 100 according to an embodiment of the present invention of FIGS. 1A-4.

A method of using (at least hereby enabling method of use 400) a multi-beverage container and mixing system 100 preferably comprising the steps of: step one 401 pouring water 160 into at least one inner volume 111 of a container housing 110 through an external door 150 and/or internal door 140 (or through a spout or by removing lid 120 to access) into a/the desired inner volume 111; step two 402 closing at least one internal door 140; step three 403 placing at least one powdered beverage mix 165 inside at least one compartment 130 of lid 120 through an external door 150; step four 404 closing external door 150; and step five 405 transporting powdered beverage mix(es) 165 and water 160 in an unmixed state.

The method of use 400 preferably further comprises the steps of: step six 406 activating internal door 140 via a push-button 147; and step seven 407 mixing powdered beverage mix 165 from at least one compartment 130 of lid 120 with water 160 in inner volume 111 of container housing 110 at a user-preferred interval, yet not mixing other powdered beverage mix(es) 165 stored in other compartment(s) 130 of lid 120, allowing beverage mix(es) 165 to be mixed independently with water 160 in designated inner volume 111 at later interval(s) (or by rinsing and re-filling water 160 if in a single inner volume 111).

It should be noted that step 405 is an optional step and may not be implemented in all cases. Optional steps of method 400 are illustrated using dotted lines in FIG. 5 so as to distinguish them from the other steps of method 400.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A multi-beverage container and mixing system comprising:

a container housing having a plurality of isolated inner volumes; and a lid having a plurality of compartments and at least one drink access spout;

wherein said lid is coupleable to said container housing;

wherein each of said compartments has an internal door and an external door;

wherein said external doors allow at least one user to fill the compartments with beverage mixes, while the internal doors allow the beverage mixes to be released into water confined in the container housing;

wherein said internal doors when activated permit fluid communication between said compartments located in said lid and said inner volumes in said container housing, whereby said beverage mixes and water may be combined;

wherein said inner volumes are defined by walls in said container housing and by said internal doors;

wherein each said internal door has a set of positive and negative magnets for attachment of said internal door to said container housing when closed; and wherein said multi-beverage container system allows said users to separately carry and mix said beverage mixes and said water in said multi-beverage container system creating different beverages at desired intervals throughout the day which said user may access and consume using said drink access spout(s).

2. The multi-beverage container and mixing system of claim 1 wherein said container housing comprises volume measurement indicia markings.

3. The multi-beverage container and mixing system of claim 1 wherein said internal doors each comprise a compressible button.

4. The multi-beverage container and mixing system of claim 3 wherein said compressible button when depressed by said user allows said beverage mixes to fall into the water within a desired said compartment.

5. The multi-beverage container and mixing system of claim 1 wherein said container housing and said lid when coupled define a cylinder that is hand-holdable.

6. The multi-beverage container and mixing system of claim 1 wherein said set of positive and negative magnets are designed to create repulsion and attraction that allow said internal doors to swing from an open position back into a closed position after use.

7. The multi-beverage container and mixing system of claim 6 wherein said internal doors comprise magnet insets.

8. The multi-beverage container and mixing system of claim 1 wherein said beverage mixes comprise powder.

9. The multi-beverage container and mixing system of claim 8 wherein said powder when mixed with said water comprises a sport drink.

10. The multi-beverage container and mixing system of claim 8 wherein said powder comprises a non-sport drink.

11. The multi-beverage container and mixing system of claim 1 wherein said container housing and said lid comprise a sealable containment assembly.

12. The multi-beverage container and mixing system of claim 11 wherein said sealable containment assembly comprises a thermal insulator.

13. The multi-beverage container and mixing system of claim 12 wherein said thermal insulator provides that said water may be kept at a lower temperature over an extended duration.

14. The multi-beverage container and mixing system of claim 12 wherein said thermal insulator provides that said water may be kept at an elevated temperature over an extended duration.

15. The multi-beverage container and mixing system of claim 1 wherein said drink access spout(s) comprise a plug.

16. The multi-beverage container and mixing system of claim 1 wherein said drink access spouts are rotably-openable.

17. A multi-beverage container and mixing system comprising:

a container housing comprising plastic having a plurality of isolated inner volumes; and a lid having a plurality of compartments and a drink access spout;

wherein said lid is coupleable to said container housing;

wherein said container housing and said lid comprise a sealable containment assembly;

wherein said sealable containment assembly comprises a thermal insulator;

wherein said thermal insulator keeps water in the container housing at a lower temperature and/or an elevated temperature over an extended duration;

wherein each of said compartments has an internal door and an external door;

wherein said internal doors each comprise a compressible button;

wherein said each compressible button when depressed by an user allows beverage mixes in each compartment to fall into the water within the container housing wherein said container housing and said lid when coupled define a cylinder that is hand-holdable;

wherein said container housing comprises volume measurement indicia markings;

wherein said external doors allow at least one user to fill the compartments with beverage mixes, while the internal doors allow the beverage mixes to be released into water confined in the container housing;

wherein said internal doors when activated permit fluid communication between said compartments located in said lid and said inner volumes in said container housing, whereby said beverage mixes and water may be combined;

wherein said beverage mixes comprise powder;

wherein said powder when mixed with said water comprises a sport drink or a non-sport drink;

wherein said inner volumes are defined by walls in said container housing and by said internal doors;

wherein each said internal door has a set of positive and negative magnets for attachment of said internal door to said container housing when closed;

wherein said set of positive and negative magnets are designed to create repulsion and attraction that allow said internal doors to swing from an open position back into a closed position after use;

wherein said internal doors comprise magnet insets; and wherein said multi-beverage container system allows said users to separately carry and mix said beverage mixes and said water in said multi-beverage container system creating different beverages at desired intervals throughout the day which said user may access and consume using said drink access spout.

* * * * *